US006927782B2

(12) United States Patent
Coldefy et al.

(10) Patent No.: US 6,927,782 B2
(45) Date of Patent: Aug. 9, 2005

(54) AIRPORT DISPLAY DEVICE

(75) Inventors: Pierre Coldefy, Toulouse (FR); Fabien Fetzmann, Toulouse (FR); Frédéric Lemoult, Toulouse (FR)

(73) Assignee: Airbus France, Toulouse (FR)

( * ) Notice: Subject to any disclaimer, the term of this patent is extended or adjusted under 35 U.S.C. 154(b) by 119 days.

(21) Appl. No.: 10/214,391

(22) Filed: Aug. 8, 2002

(65) Prior Publication Data

US 2003/0179215 A1 Sep. 25, 2003

(30) Foreign Application Priority Data

Mar. 20, 2002 (FR) ..... 02 03473

(51) Int. Cl.[7] ..... G09G 5/00

(52) U.S. Cl. ..... 345/619; 345/626; 345/629; 345/660; 345/661; 345/670; 345/671

(58) Field of Search ..... 345/619, 626, 345/629, 660, 661, 670, 671

(56) References Cited

U.S. PATENT DOCUMENTS

| | | | | |
|---|---|---|---|---|
| 4,729,029 | A | 3/1988 | Henri et al. | |
| 6,246,342 | B1 * | 6/2001 | Vandevoorde et al. | 340/961 |
| 6,314,370 | B1 * | 11/2001 | Curtright | 701/213 |
| 6,353,794 | B1 * | 3/2002 | Davis et al. | 701/201 |
| 6,405,975 | B1 * | 6/2002 | Sankrithi et al. | 244/1 R |
| 2002/0004692 | A1 * | 1/2002 | Nicosia et al. | 701/16 |
| 2002/0116097 | A1 * | 8/2002 | Block et al. | 701/9 |

FOREIGN PATENT DOCUMENTS

| | | |
|---|---|---|
| DE | 3939110 | 5/1990 |
| EP | 0529121 | 3/1993 |
| EP | 0980828 | 2/2000 |
| WO | 0169585 | 9/2001 |

OTHER PUBLICATIONS

Search Report dated Jan. 31, 2003 with English translation.
NASA/CR–1998–208446, "Integrated Display System For Low Visibility Landing and Surface Operations", Jul. 1998, pp. 1–59.

* cited by examiner

*Primary Examiner*—Matthew C. Bella
*Assistant Examiner*—Mike Rahmjoo
(74) *Attorney, Agent, or Firm*—Stevens, Davis, Miller & Mosher, LLP

(57) ABSTRACT

The display device (1) comprises display means (2) comprising a screen (3), a data base (4) provided with data on the airport, an actuating system (5) for selecting a degree of zoom, a central unit (6) that controls the display means (2) such that it shows the airport on the screen (3) according to a scale value representative of a selected degree of zoom, and a means (10) making it possible to parameterize scale values. The display means (2) shows the airport solely in plan view on the screen (3), and the central unit (6) controls it such that it shows on the screen (3) details, according to one of a plurality of different levels of detail, each of the said levels of detail being dependent on the selected degree of zoom.

13 Claims, 3 Drawing Sheets

AIRPORT DISPLAY DEVICE

The present invention relates to an airport display device.

The complexity of certain airports, the increase in air traffic and the existence of installations that are often poorly adapted to aircraft that are increasingly large and numerous create traffic difficulties on the runways and taxiways of airports, which often give rise to lengthening of the taxiing times, and sometimes to more or less serious incidents and, unfortunately, also to accidents.

In this context, an increasingly high number of "runway incursions" is observed, that is to say situations in which an unauthorized aircraft (or another moving object such as a technical vehicle of the ground support personnel, for example) moves onto a runway which is being used at the same time in a regular manner by another aircraft in order to land or take off. Such a runway incursion is very dangerous, since it puts the lives of the occupants of both aircraft in danger.

For safety reasons, it is therefore important, or even imperative, that each pilot can observe the environment around his aircraft in the most efficient way possible.

Through the document EP-0 980 828, a system is known which is installed on an aircraft in order to assist the pilot of the aircraft during ground maneuvers. For this purpose this system comprises a first video camera that generates video images of the forward landing gear and of an area around the latter, a second video camera which generates video images of the main landing gears and of the areas around the latter, and display means that are fitted in the piloting position and which display the video images generated by the said first and second video cameras (which are fixed to the fuselage).

This known system therefore provides the pilot with information that enables him to make maneuvers during a taxiing operation with increased safety. In particular, by observation of the landing gears and of the areas around the latter, he can prevent a landing gear from striking an obstacle on the ground or which does not leave the runway or taxiway on which the aircraft is moving.

However, this known system does not provide any information on the whole (or at least on an extended area) of the runway or of the taxiway. Now, such a lack of information can be dangerous, particularly in poor visibility (fog, etc). In fact, another moving object, in particular another aircraft, can be on the same runway (or the same taxiway) at the same time and, due to lack of information, a situation can arise in which a collision cannot be avoided, in particular if the other moving object is moving at very high speed such as occurs during the take off or landing of an aircraft for example.

The system described in the document EP-0 980 828 also has other disadvantages, in particular the fact that the angles of view are not optimal. The result of this is that the perspective views displayed by this known system has blind spots, for example under the wings where the main landing gear of the aircraft is not seen (the position of the latter only being symbolized) and neither is the possible border of the taxiway or of the runway.

Furthermore, a display system making it possible to partially overcome the said disadvantages is known from an article by Beskenis, Green, Hyer and Johnson entitled "Integrated Display System for Low Visibility Landing and Surface Operations" which appeared in the publication "NASA Langley Technical Report", July 1998, NASA/CR-1998-208446. This display system comprises, in particular, display means making it possible to exhibit on a screen mounted in the piloting position of the aircraft a map of the airport showing the runways, the taxiways and the various buildings, as well as the position of the aircraft and the traffic existing on that airport. This known system furthermore comprises an actuating means allowing the pilot to choose between an overall view of the airport in planview and various perspective views of a part of the airport, which have various different degrees of zoom (that is to say different scales).

Even though it thus presents the pilot with a view of the airport with the corresponding traffic, which allows the said pilot to form an idea of the real situation, this known system has several disadvantages. In particular, it is a frozen system and is not adaptable to different airports. Furthermore, the presentation of data used by this system is not very legible.

In fact, with this known system, the various displays offered are always the same no matter which airport is being used. Now, airports can of course be of very different sizes, of variable complexities and can include buildings in different quantities and sizes. Consequently, a presentation of information that is adapted to a particular type of airport (small size and few runways and buildings for example) is not generally adapted to another (very large and complex with numerous runways for example), and nothing in this known system makes it possible to take account of such different characteristics.

Furthermore, the presentation of information is not very legible, in particular because of the high number of elements (runways, taxiways, buildings, traffic, etc.) that is present on the display screen, particularly when the degree of zoom is low (a complete view of the airport for example). The legibility is also reduced by the use of different types of views: perspective views, plan views. Thus the pilot always needs a certain amount of time to understand the new display correctly when there is a change of type of view, this loss of time of course being a nuisance in certain situations.

The purpose of the present invention is to overcome these disadvantages. It relates to an airport display device allowing a highly legible display and adaptable to different characteristics (size, complexity, etc.) of the airport.

For this purpose, according to the invention, the said display device of the type comprising:

- at least one display means comprising at least one display screen;
- at least one database containing data relating to the airport;
- an actuating system making it possible for an operator to select a degree of zoom for the airport to be displayed, from among a plurality of different degrees of zoom; and
- a central unit which is connected to the said display means, to the said data base and to the said actuating system and which controls the said display means such that it exhibits on the said display screen at least a part of the airport, and that it does so according to a scale value that is representative of a degree of zoom selected by the intermediary of the said actuating system, is noteworthy in that it furthermore comprises at least one means making it possible for an operator to parameterize at least certain of the said scale values that are of the type that can be parameterized, in that the said display means exhibits the said part of the airport solely in plan view on the said display screen, and in that the said central unit controls the said display means such that it exhibits details of the airport on the display screen, according to one of a plurality of different levels of detail, each of the said levels of detail being dependent at least on the selected degree of zoom.

Thus, because of the invention, at least certain of the said scale values (relating to different degrees of zoom) can be parameterized, which makes it possible in particular to adapt these scale values to the characteristics (size, complexity, etc) of the airport to be displayed.

Furthermore, by the possible adaptation of the level of details that are displayed to the selected degree of zoom (or scale value), it is possible to choose a level of details which makes it possible to display the greatest possible amount of details without by so doing overloading the display screen. This therefore makes it possible to make the presentation of information very legible. Of course, according to the invention, when the degree of zoom increases (that is to say with the part of the airport shown on the display screen becomes smaller), the level of detail increases [that is to say new information (or details) is added to the display screen].

The legibility is also increased by the presentation of the views (of part of or all of the airport) exclusively in plan view. Thus, the pilot does not have to recognize a new type of presentation when there is a change of view. Furthermore, a plan view makes it possible to assess easily the distances between the various elements of the airport and to gain a good understanding of the relative disposition of these elements, in particular in comparison with a perspective view.

Furthermore, the said actuating system advantageously comprises:

- at least one first actuating means making it possible (for an operator) to modify (continuously or step by step) the selected degree of zoom, in both directions, between two limit degrees; and/or
- at least one second actuating means making it possible (for an operator) to select directly one of at least three different degrees of zoom, respectively relating to:
  - general navigation
  - proximity navigation; and
  - precision taxiing.

In this way the operator can have direct access to preferred degrees of zoom; and/or

- at least one third actuating means making it possible (for an operator) to control, by the intermediary of the central unit, the said display means in such a way that it automatically centers the part of the airport that it is showing on the said display screen on a characteristic sign illustrating the position of a moving object, in particular an aircraft, provided with the said display device; and/or
- at least one fourth actuating means making it possible (for an operator) to control, by the intermediary of the central unit, the said display means such that it centers the part of the airport that it is showing on the said display screen on predefined points of the airport, in a cyclic manner, whilst modifying the view at each new actuation of the said fourth actuating means.

In a preferred embodiment, the said actuating system furthermore comprises at least one fifth actuating means making it possible (for an operator):

- starting from a first degree of zoom, to gain access, by a first actuation of the said fifth actuating means, to a second degree of zoom allowing a presentation of the whole of the airport on the said display screen; and
- starting from this second degree of zoom, to return, by a second actuation of the said fifth actuating means, to the said first degree of zoom.

The return is generally made to the same part of the airport that was shown before the display of the whole of the airport.

However, in a particular preferred embodiment, the said actuating system furthermore comprises at least one sixth actuating means making it possible (for an operator) to select a point of the airport upon which the part of the airport which is shown on the display screen is then centered. Thus, the return (to the said first degree of zoom) can take place on a new part of the airport that has been selected previously, using this sixth actuating means.

Furthermore and advantageously, the display device according to the invention furthermore comprises a means making it possible to displace the part of the airport that is displayed on the display screen.

Furthermore, in a preferred embodiment, the said central unit is made:

- such that a variation of zoom between two different degrees of zoom appears continuous to an operator looking at the said display screen; and/or
- such that a displacement of the part of the airport that is displayed on the display screen appears continuous to an operator looking at the said display screen.

Thus a (visually) continuous transformation of the airport (or of the part of the airport) that is displayed on the screen is obtained, which of course is advantageous with regard to the legibility of the presentation of information.

Furthermore, with the same objective, when the said display means comprises at least two different display modes, as is the case for a navigation screen of the ND ("Navigation Display") type for example, the said central unit is made such that, during a change of mode from a first mode to a second mode, it successively causes on the said display screen at least the disappearance of a mask relating to the said first mode, a displacement of the aircraft part that is displayed and the appearance of a mask relating to the said second mode.

According to the invention, the following elements in particular are shown on the display screen: the runways, the taxiways, the buildings, . . . , and the traffic (aircraft, etc.). Also, in order to be able to display the traffic in real time, the said display device advantageously furthermore comprises means making it possible to load data (in particular that relating to traffic) in real time into the said data base which is therefore of the dynamic type.

Furthermore and advantageously:

- in a first embodiment, the said display device is integrated in a portable computer; and
- in a second embodiment, the said display means is a display system of an aircraft to which the said device according to the invention is fitted, and the elements of the said device, other than the said display means, form part of a specific assembly.

The figures of the appended drawing will give a good understanding of how the invention can be embodied. In these figures, identical references denote similar elements.

Figure 1:
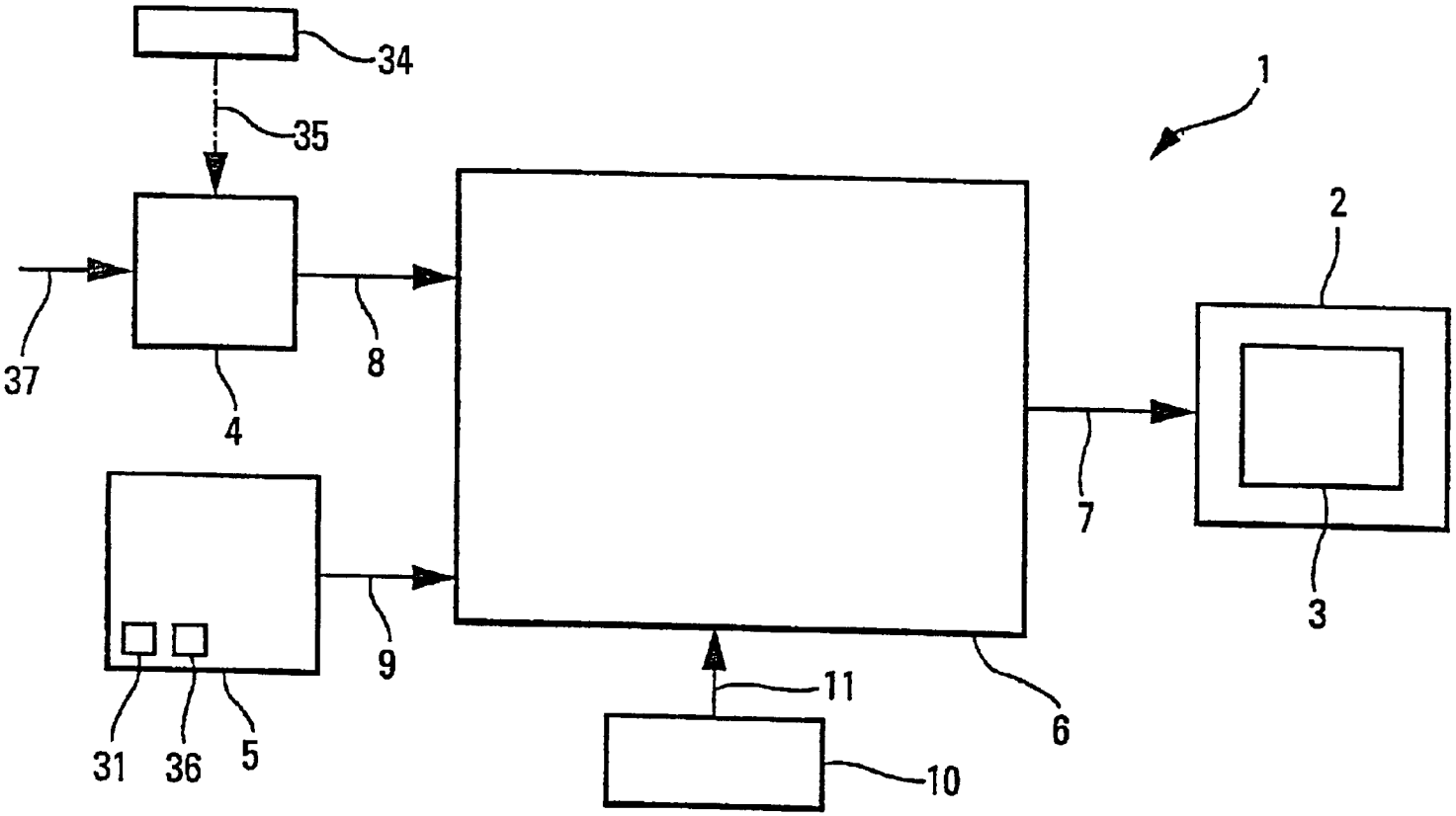
FIG. 1 is a block diagram of a display device according to the invention.

The device 1 according to the invention and shown diagrammatically in FIG. 1 is intended to display at least a part of an airport. This device 1 is preferably installed in the piloting position of an aircraft. It can however also be fitted to another moving object traveling on the airport, such as a vehicle of a ground technical service (cleaning, maintenance, safety, etc) for example. It can even be used by a pedestrian, in particular to locate himself on the airport.

The device 1 is of the type comprising:

at least one display means 2 comprising at least one display screen 3 of normal type;

at least one data base 4 provided with data relating to the airport, which it can receive for example by a link 37;

an actuating system 5 making it possible for an operator to select a degree of zoom for the airport to be displayed, from among a plurality of degrees of zoom; and a central unit 6 which is connected by the intermediary of links 7, 8 and 9 to the said display means 2, to the said data base 4 and to the said actuating system 5 respectively and which controls the said display means 2 such that it shows on the said display screen 3 at least a part of the airport according to a scale value representative of a degree of zoom which has been selected by the intermediary of the said actuating system 5.

According to the invention:

at least certain of the said scale values can be parameterized, and the said display device 1 furthermore comprises a means 10 which is connected by a link 11 to the central unit 6 and which makes it possible for an operator to parameterize the said scale values that can be parameterized. These means 10 can, for example, be a numerical keypad allowing an operator to enter new scale values;

the display means 2 shows, on the screen 3, only plan views of the airport (or of a part of the latter); and the central unit 6 controls the said display means 2 such that it presents on the screen 3 a set of details that conforms with one of a plurality of different levels of detail. Each of these different levels of detail depends at least on the degree of zoom that is selected by the intermediary of the actuating system 5. In a particular embodiment, these levels of detail can also depend on other factors such as the position of the aircraft for example. Thus, according to the invention, if an operator selects a new degree of zoom that is such that the displayed zone becomes more restricted, the level of detail increases on the display screen 3, that is to say new information not previously shown is the displayed, and vice-versa of course.

Thus, as at least certain of the scale values (that are associated with different degrees of zoom that can be selected) can be parameterized, it is possible to adapt these scale values to the characteristics (size, complexity, etc.) of the airport to be displayed. It can easily be understood that it is not judicious to use the same scale value (that is to say the same ratio between the shown representation of a length and the corresponding real length) for two airports, one of which is much bigger (for example twice as big) and more complex (more runways, etc.) than the other. Consequently, the display device 1 according to the invention can be adapted to any type of airport, whatever its size or complexity may be in particular.

Furthermore, the exclusive use of plan views to represent the airport provides visual comfort to the pilot and facilitates the reading of the views.

Figure 2A:
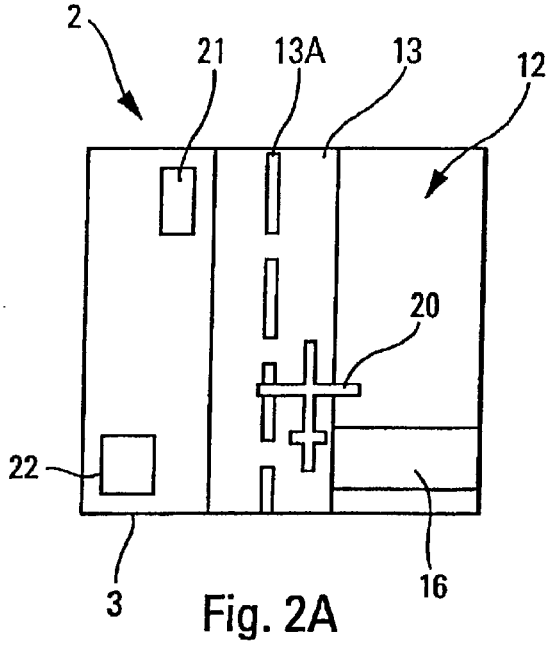
FIGS. 2A and 2B show views that are similar but which correspond to different degrees of zoom.
Figure 2B:
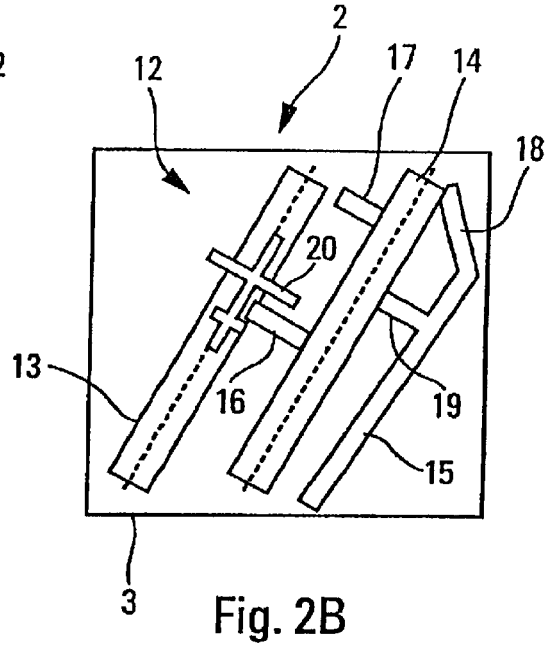

The same applies to the adaptation of the levels of detail to the degrees of zoom (and therefore to the scale values) selected, as can be seen by referring to FIGS. 2A and 2B which show two views of the airport 12 on the display screen 3, corresponding to two different degrees of zoom for the same real situation.

FIG. 2B illustrates an overall view of the airport 12, which shows:

runways 13 and 14;

a taxiway 15;

bi-pass taxiways 16, 17, 18 and 19; and a special sign 20 illustrating the position of the aircraft (equipped with the said device 1) which is located on the runway 13 at the level of the bi-pass taxiway 16.

FIG. 2A illustrates the same situation as that of FIG. 2B, after having zoomed (selected a higher degree of zoom by means of the said actuating system 5). Thus, only a part of the airport 12 (around the aircraft 20) is shown. Furthermore, as the degree of zoom increases, the level of detail also increases according to the invention such that elements 21 and 22, which were not visible in the overall view of FIG. 2B now appear in FIG. 2A. These elements 21 and 22 (for example panels or electrical cabinets) are represented diagrammatically in this FIG. 2A.

According to the invention, a level of detail is chosen for each degree of zoom which simultaneously allows easy reading of the information presented on the screen 3 and provides an appropriate density of this information.

Figure 3:
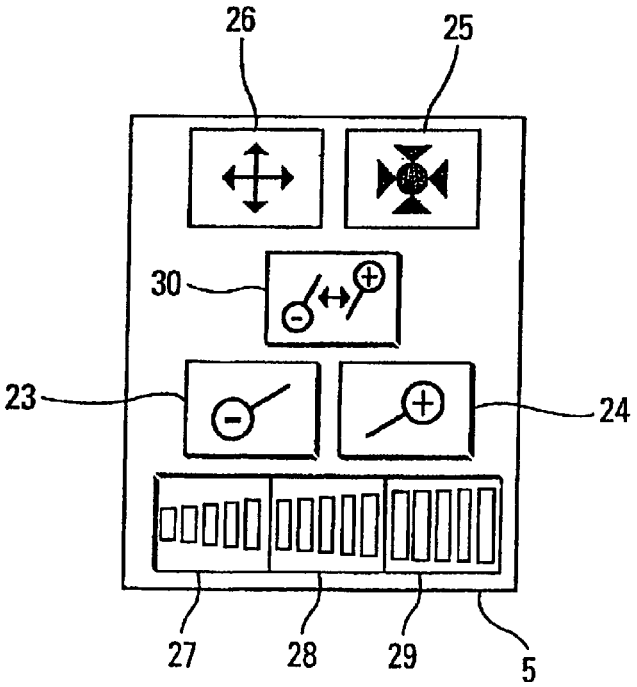
FIG. 3 is a diagrammatic representation of a particular embodiment of an actuating system.

Furthermore, as shown in FIG. 3, the said actuating system 5 comprises:

actuating means 23 and 24 which make it possible for an operator to modify the degree of zoom selected, in the direction of decreasing degrees of zoom for the actuating means 23 and in the direction of increasing degrees of zoom for actuating means 24, and for this to be between two limit degrees of zoom. The scale values corresponding to these two degrees of zoom respectively can be parameterized and therefore be adapted to the characteristics of the airport to be displayed. In the context of the present invention, the said actuating means 23 and 24 can modify the degree of zoom either continuously or step by step;

an actuating means 25 for automatically centering the part of the airport 12 that is displayed, about the effective position 20 of the aircraft. It is also possible to make provision for the said actuating system 5 to furthermore comprise at least one actuating means, for example the means 31 represented diagrammatically in FIG. 1, making it possible to control the central unit 6 such that the display means 2 centers the part of the airport that it shows on the said screen 3, on predefined points of the airport, and that it does so in a cyclic manner, by modifying the view at each new actuation of the said actuating means 31; and a means 26 making it possible to displace the part of the airport that is displayed on the display screen 3, in all directions.

Furthermore, the actuating system 5 comprises three associated actuating means 27, 28 and 29 that make it possible to gain direct access to different degrees of zoom that have in particular been defined according to the operational requirements of the pilots. The displays obtained respectively by actuating the said actuating means 27, 28 and 29 are particularly appropriate for helping the pilot respectively during:

general navigation. The corresponding degree of zoom allows a good display of the whole of the airport 12 in order to be able, on the one hand, to have a better understanding of its complexity and, on the other hand, to display any routing whatsoever in its entirety. It is therefore a matter of strategic navigation;

proximity navigation. The corresponding degree of zoom makes it possible for the pilot to navigate in the short term and to observe many parameters relating to his position, and his close environment. In this case it is a matter of tactical navigation; and precision taxiing, making it possible to respond to the problems of maneuverability and of positioning of the aircraft 20 on a runway 13, 14, a taxiway 15, a parking place, when approaching a gate or for carrying out a maneuver on a turning area (generally located at the end of a runway to allow large aircraft to turn around).

Of course, as mentioned above, the scale values associated with these different degrees of zoom can be parameterized and can be adapted to the airport in particular.

Furthermore, the said actuating system 5 also comprises an actuating means 30 which makes it possible:

starting from a first view according to a first degree of zoom, for example the view shown in FIG. 2A (or in FIG. 4A), to gain access directly to an overall view of the airport 12, as shown in FIG. 2B (or in FIG. 4B), without having to carry out other actions; and starting from this overall view (FIG. 2B), to return automatically to a view, for example the initial view (FIG. 2A), that shows the said first degree of zoom.

Figure 4C:
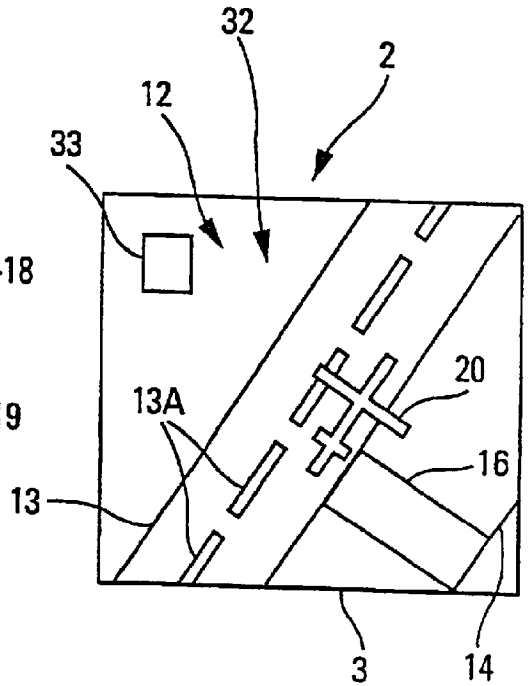
FIGS. 4A to 4C show different views making it possible to explain a particular characteristic of the present invention.
Figure 4B:
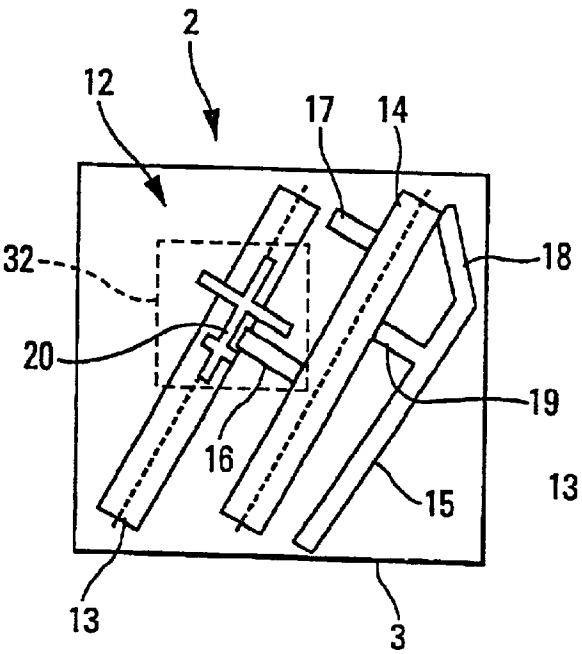
Figure 4A:
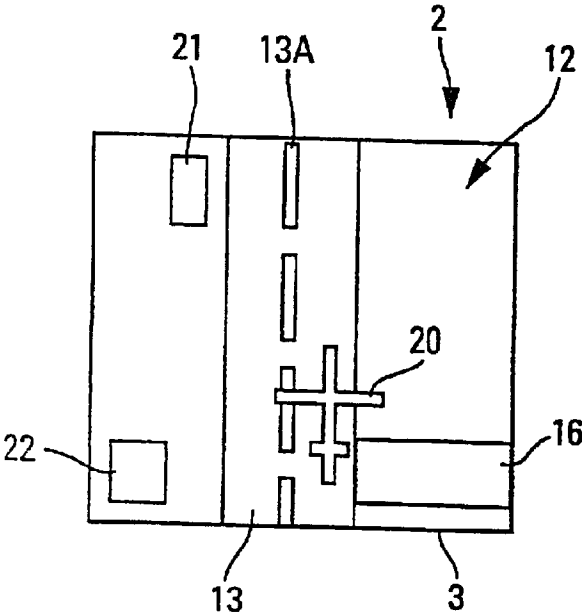

In this case, in a particular embodiment illustrated in FIGS. 4A to 4C, the actuating system 5 can also comprise an actuating means, such as the means 36 represented in FIG. 1, which makes it possible, starting from the overall view shown in FIG. 4B, to select a part 32 of the airport 12 in such a way that an actuation of the actuating means 30 then results in the display of the partial view represented in FIG. 4C. This partial view shows the said first degree of zoom (relating to FIG. 4A) but shows the selected part 32 and not the part displayed initially in FIG. 4A. Starting from this partial view of FIG. 4C, there is a return to an overall view (FIG. 4B) by a new actuation of the said actuating means 30.

This latter function will in particular assist the pilot, if he is lost, to locate himself in the airport 12, to search for a precise point in a graphical manner and to observe the surrounding traffic, if the working degree of zoom makes it possible to observe only a small area of the airport (high degree of zoom).

It will be noted that, according to the invention, on increasing the degree of zoom on changing from FIG. 4B to FIG. 4C, new details appear such as the element 33 (for example a panel) which were not previously shown in order not to overload the view.

Furthermore, the device 1 according to the invention is designed in such a way as to cause a continuous transformation of the displayed information with no sudden changes of information, for example during a variation of zoom or a change of mode such as described below, in order to make the presentation of information as legible as possible in such a situation.

In order to do this, according to the invention, the said central unit 6 is made:

such that a variation of zoom between two different degrees of zoom appears continuous to an operator looking at the said display screen 3. In order to do this, it suffices to parameterized a sufficient number of time slots, associated with a sufficiently short self-repetition time of the function, to maintain the visual illusion of continuity. In practice, if the repetition rate exceeds a certain threshold (10 Hz for example), the image is considered to be sufficiently fluid; and such that a displacement of the part of the airport that is displayed on the display screen 3 appears continuous to an operator looking at the said display screen 3.

The central unit 6 is also made in such a way as to cause a continuous transformation of the information displayed during change of mode, when the said display means 2 comprises a plurality of modes, such as an ND ("Navigation Display") type navigation screen for example.

It is known that such an ND navigation screen comprises the following modes:

a so-called "Rose" mode, in which the aircraft is at the center of the display screen 3. It is fixed and the nose faces upwards. Several concentric circles provide a scale of reference for rapidly and visually measuring distances. The pilot can thus easily locate his aircraft on the map of the airport, which rotates and slides in accordance with the movements carried out;

a so-called "Arc" mode, in which the aircraft is at the bottom of the display screen 3, at the center of several arcs of circle, whose separation corresponds to the selected degree of zoom. The map rotates and slides in accordance with the movements of the aircraft, which remains fixed, as in the "Rose" mode; and a so-called "Plan" mode. This is therefore a plan view of the airport, oriented towards the North. The aircraft moves over this map, which is fixed. The "Plan" mode also comprises a mask which resembles that of the "Rose" mode (it consists of circles), but it is a little more detached and separated from the aircraft symbol.

When it comprises several modes such as the said modes, the display means 2 is controlled, according to the invention, by the central unit 6, in such a way as to implement the following successive operations, during a change of mode (change from a first mode to a second mode):

disappearance of the mask described below, relating to the first mode;

continuous sliding of the map displaying the airport;

appearance and disappearance on the display screen 3 of different elements as they enter or leave the display during the automatic sliding of the map; and appearance of the new mask relating to the second mode.

It is known that a mask relating to a particular mode usually comprises a circular scale (for the masks of the "Rose" and "Plan" modes or a semicircular scale (for the mask of the "Arc" mode), representing headings, and a scale, representing distances, situated on the different arcs of circle composing the said masks. The arcs of circle are concentric and distributed in a regular manner. It is possible, by a preferred adjustment, for the operator to be able:

either to fix the diameters of the arcs of circle corresponding to the masks, which involves a modification of the value displayed for the distance depending on the degree of zoom;

or to allow the different arcs of circle to resize themselves such that the displayed value of the scale of distances is an integer value that is simpler to interpret.

The masks are therefore objects that inform the operator on the orientation of the aircraft whilst associating it with a concept of distance.

It will be noted that the function used by the actuation of the previously described actuating means 30 necessitates special processing, comprising the following successive steps:

reduction of the degree of zoom down to the minimum degree of zoom;

disappearance of the mask, if it is different from the mask of the said "Plan" mode;

appearance of the "Plan" mode mask, if the preceding mode was different; and continuous displacement of the map displayed on the screen 3 in order to center the airport on the middle of the screen 3 and thus to display it in its entirety.

Starting from this point:

it is possible to repeat the preceding operations in the reverse order, if the operator wishes to return to the initial display;

it is also possible to carry out the following operations:

recentering, by continuous displacement of the map, on a point selected by the operator; and increasing the degree of zoom up to the initial degree of zoom (the value recorded at the moment of the initial activation of the function).

Furthermore, if the operator wishes to recenter the image on the aircraft (actuating means 25) or on a characteristic point of the airport (actuating means 31), the device 1 carries out the following operations:

reduction of the degree of zoom down to the appearance of the symbol 20 illustrating the aircraft or of the characteristic point on the screen 3;

continuous displacement of the map in order to center it on the symbol 20 or on the characteristic point; and return to the initial value of the degree of zoom.

Furthermore, if the display is not centered on the symbol 20 of the aircraft and the operator wishes to return to the "Arc" or "Rose" mode, the device 1 carries out the following operations:

reduction of the degree of zoom down to the appearance of the symbol 20 on the screen 3;

disappearance of the mask of the "Plan" mode;

continuous displacement of the map in order to center it on the symbol 20 (centering relating to the desired mode: in the center for the "Rose" mode, at the bottom for the "Arc" mode);

appearance of the new mask; and return to the initial value of the degree of zoom.

Moreover, the device 1 according to the invention furthermore comprises means 34 making it possible to update in real time, in a dynamic manner, the data base 4, as illustrated by a link shown in dotted and dashed line 35 in FIG. 1. In particular, this makes it possible to be able to record in the data base 4, in real time, the traffic (other aircraft, technical vehicles, etc.) that can thus be shown (also in real time) on the screen 3. The presentation of traffic consists in particular of showing on the map of the airport that is displayed the position of each moving object (aircraft, technical vehicles, etc) and, possibly, of identifying each one of these moving bodies by a special sign or a code or a special number. Preferably, the said updating is carried out by means of digital data transmission links of the usual type between the device 1 which is installed in an aircraft for example and a station located on the ground.

In the context of the present invention, the actuating system 5 can be of different types. In particular it can be:

a touch-sensitive screen, each of the said actuating means 21 to 31 and 36 then corresponding to a particular (touch) sensitive area;

a keyboard, each of the said actuating means 21 to 31 and 36 then representing at least one particular key; or an assembly formed from a computer type panel and a selector (in particular a roller ball) making it possible to select and confirm the said different sensitive areas of the said computer panel. Preferably, the said selector is a means (roller ball, touchpad, miniature joystick, etc) which is firmly attached to a fixed support.

These different types of actuating system 5 that are fixed make it possible to carry out an easy and accurate actuation of one of the said actuating means 23 to 31 and 36, in particular in the presence of aircraft vibrations and/or in conditions where the pilot is stressed.

As mentioned previously, the ground map does not constitute the totality of the data base 4. Dynamic elements are included, such as traffic and information specific to the airline companies using the said device 1, by the intermediary of the means 34.

Furthermore and advantageously:

in a first embodiment, the said display device 1 is integrated in a portable computer that can be installed in the piloting position of an aircraft; and in a second embodiment, the said display means 2 is a display system (for example a navigation screen of the ND ("Navigation Display") type of the aircraft in which the said device 1 is installed, and the elements 4, 5, 6, . . . of the said device 1, other than the said display means 2, are part of a specific assembly.

What is claimed is:

1. An airport display device, comprising:

at least one display unit that comprises at is least one display screen;

at least one data base that contains data relating to an airport;

an actuating system that selects a degree of zoom for the airport to be displayed, from among a plurality of different degrees of zoom;

a central unit which is connected to said display unit, to said data base and to said actuating system and which controls said display unit such that it exhibits on said display screen at least a part of the airport, and that it does so according to one of a plurality of scale values representative of the degree of zoom selected by an intermediary of said actuating system; and at least one parameterization unit that is operable by an operator to parameterize at least certain ones of aid scale values, in that said display unit exhibits said part of the airport solely in plan view on said display screen, and in that said central unit controls said display unit such that it exhibits details of the airport on the display screen, according to one of a plurality of different levels of detail, each of said levels of detail being dependent at least on the selected degree of zoom, wherein:

said actuating system comprises at least one third actuating unit that controls the display unit in such a way that it automatically centers the part of the airport that it is showing on said display screen on a characteristic sign illustrating the position of a moving object provided with said device.

2. The device of claim 1, wherein said actuating system comprises at least one first actuating unit that modifies the selected degree of zoom, in both directions, between two limit degrees.

3. The device of claim 1, wherein said actuating system comprises at least one second actuating unit that selects directly one of at least three different degrees of zoom, respectively relating to:

general navigation proximity navigation; and precision taxiing.

4. The device of claim 1, wherein said actuating system furthermore comprises at least one fifth actuating unit that is operable by an operator to:

starting from a first degree of zoom, gain access, by a first actuation of said fifth actuating unit, to a second degree of zoom allowing a presentation of the whole of the airport on said display screen; and starting from this second degree of zoom, return, by a second actuation of said fifth actuating unit, to said first degree of zoom.

5. The device of claim 1, further comprising a displacement unit that displaces a display of the part of the airport that is displayed on the display screen.

6. The device of claim 1, wherein said central unit is made such that a variation of zoom between two different degrees of zoom appears continuous to the operator looking at said display screen.

7. The device of claim 1, wherein said central unit is made much that a displacement of the display of the part of the airport that is displayed on the display screen appears continuous to the operator looking a said display screen.

8. The device of claim 1, wherein said display unit comprises at least two different display modes, and in that said central unit is made such that, during a change of mode from a first mode to a second mode, it successively causes on said display screen at least the disappearance of a mask relating to said first mode, a displacement of a display of an aircraft part that is displayed and the appearance of a mask relating to said second mode.

9. The device of claim 1, further comprising a loading unit that loads data in real time into said data base.

10. The device of claim 1, wherein the device is integrated in a portable computer.

11. The device of claim 1, wherein said display unit is a display system of the aircraf in which said device is installed, and in that elements of said device, other than said display unit, are part of a specific assembly.

12. An airport display device, comprising:

at least one display unit that comprises at least one display screen;

at least one data base that contains data relating to an airport;

an actuating system that selects a degree of zoom for the airport to be displayed, from among a plurality of different degrees of zoom;

a central unit which is connected to said display unit, to said data base and to said actuating system and which controls said display unit such that it exhibits on said display screen at least a part of the airport, and that it does so according to one of a plurality of scale values representative of the degree of zoom selected by an intermediary of said actuating system; and at least one parameterization unit that is operable by an operator to enter new scale vales in order to adapt these new scale values to the characteristics of the airport to be displayed, in that said display unit exhibits said part of the airport solely in plan view on said display screen, and in that said central unit controls said display unit such that it exhibits details of the airport on the display screen, according to one of a plurality of different levels of detail, each of said levels of detail being dependent at least on the selected degree of zoom, wherein said actuating system comprises at least one fourth actuating unit that controls the display unit such that at it centers the part of the airport that it is showing on said display screen on predefined points of the airport, in a cyclic manner, whilst modifying the view at each new actuation of said fourth actuating unit.

13. An airport display device, comprising:

at least one display unit that comprises at least one display screen;

at least one data base that contains data relating to an airport;

an actuating system that selects a degree of zoom for the airport to be displayed, from among a plurality of different degrees of zoom;

a central unit which is connected to said display unit, to said data base and to said actuating system and which controls said display unit such that it exhibits on said display screen at least a part of the airport, and that it does so according to one of a plurality of scale values representative of the degree of zoom selected by an intermediary of said actuating system; and at least one parameterization unit that is operable by an operator to enter new scale vales in order to adapt these new scale values to the characteristics of the airport be displayed, in that said display unit exhibits said part of the airport solely in plan view on said display screen, and in that said central unit controls said display unit such that it exhibits details of the airport on the display screen, according to one of a plurality of different levels of detail each of said levels of detail being dependent at least on the selected degree of zoom, wherein said actuating system furthermore comprises at least one sixth actuating unit that selects a point of the airport upon which the part of the airport which is shown on the display screen is then centered.

* * * * *